United States Patent [19]

Means

[11] 4,332,199

[45] Jun. 1, 1982

[54] ELECTROMAGNETIC ARMING RATE REGULATOR

[75] Inventor: James E. Means, China Lake, Calif.

[73] Assignee: The United States of America as represented by the Secretary of the Navy, Washington, D.C.

[21] Appl. No.: 157,723

[22] Filed: Jun. 9, 1980

[51] Int. Cl.[3] ..... F42C 9/00

[52] U.S. Cl. ..... 102/276

[58] Field of Search ..... 102/276, 228, 232, 238, 102/248, 255, 257, 264

[56] References Cited

U.S. PATENT DOCUMENTS

| | | | |
|---|---|---|---|
| 2,415,362 | 2/1947 | Midgley | 102/276 |
| 2,554,523 | 5/1951 | Clifford | 185/46 |
| 2,946,183 | 7/1960 | Clifford | 58/116 |
| 2,973,619 | 3/1961 | Clifford | 58/116 |
| 3,149,269 | 9/1964 | Glaser et al. | 317/201 |
| 3,208,287 | 9/1965 | Ishikawa et al. | 74/1.5 |
| 3,332,354 | 7/1967 | Silvers et al. | 102/276 |
| 3,434,424 | 3/1969 | Lohninger | 102/276 |
| 3,547,035 | 12/1970 | Brackman | 102/248 |
| 3,660,737 | 5/1972 | Sakai et al. | 318/138 |
| 3,685,277 | 8/1972 | Fedchenko | 58/23 D |
| 3,719,839 | 3/1973 | Endo | 310/49 |
| 3,786,750 | 1/1974 | Zacharin | 102/257 |

*Primary Examiner*—Charles T. Jordan

*Attorney, Agent, or Firm*—Robert F. Beers; W. Thom Skeer

[57] ABSTRACT

A device for adjustably changing the arming time of a projectile having an arming mechanism for arming the projectile at a predetermined rate is presented. A pallet made of magnetically susceptable material and supported for repetitive movement is disposed within a generated magnetic field. The pallet is connected to the arming mechanism for corresponding movement therewith and is driven by the arming mechanism while arming. The magnetic field induces within the pallet, magnetic losses which retards the arming rate.

14 Claims, 1 Drawing Figure

ELECTROMAGNETIC ARMING RATE REGULATOR

BACKGROUND OF THE INVENTION

The present invention relates to arming mechanisms for projectiles, and more particularly, to a regulator for adjusting the arming time of such an arming mechanism.

Projectiles such as ballistic projectory shells and bombs, and self-propelled missiles are provided with an arming mechanism for arming the projectile after it has been dispatched towards its intended target. Once the projectile is dispatched, the arming mechanism, often powered by motional forces generated by the projectile, arms the projectile prior to arrival at the destination. However, projectiles are used in many diverse situations. For example, in surface-to surface or air-to-air missiles, the time between dispatch of the projectile from a ship and arrival of the projectile at a target is extremely short requiring that the projectile be armed quickly. For a bomb dropped from a considerable height, the time for the bomb to arrive at the target is considerable longer thereby permitting a longer time for arming. Each of the different projectiles for a different use requires that the arming mechanism be provided at the time of manufacture with a predetermined arming time for the particular intended use which is not adjustable at a later time. Accordingly, it is desirable that a projectile be provided having a universal arming mechanism therein with the arming time of the arming mechanism being adjustable. Additionally, it is desirable that the arming time adjustment mechanism be reliable, compact, and low cost.

SUMMARY OF THE INVENTION

The present invention relates to a device for adjusting the arming time of a projectile. A pallet made of magnetically susceptable material is connected to the arming mechanism and supported for corresponding movement therewith. The pallet is reciprocally connected to the arming mechanism, i.e., the pallet is driven for movement by the arming mechanism while arming and, alternatively, the pallet can effect the operation of the arming mechanism. A magnetic field generated by an electromagnet induces within the pallet magnetically related losses such as hysteresis and eddy currents. These generated magnetic losses work to slow down and change the arming rate of the arming mechanism. The electromagnet is powered by a power supply which can supply either direct current or alternating current to the coil of the electromagnet. When the pallet is made of magnetically soft material such as iron, the power supply can provide either direct current for generating a steady state constant magnetic field or an alternating current for generating an alternating field. In such a case the quantity of magnetic losses induced in the pallet is dependent upon the strength of the magnetic field and additionally, in the case of an alternating field, the frequency of the alternating field. In such a case, the magnetically induced losses can comprise hysteresis and eddy currents. Alternately, the pallet can be made of a magnetically susceptable non-magnetic material such as aluminum and in such a case the power supply provides an alternating current for inducing eddy current losses. The strength of the magnetically induced losses is dependent upon the strength and frequency of the magnetic field. The rate of arming is adjustable by adjusting the strength of the generated magnetic field and/or the frequency of the magnetic field.

OBJECTS OF THE INVENTION

With reference to the background of the invention hereinabove, accordingly, it is an object of the present invention to provide a device for adjusting the arming time of a projectile having an arming mechanism for arming the projectile at a predetermined rate.

Another object of the present invention is to provide a device for adjusting the arming time of a projectile wherein a pallet of magnetically susceptable material is supported for repetitive movements corresponding to movement of the arming mechanism and a magnetic field generated by an electromagnetic means adjustably induces within the pallet magnetically related losses for retarding movement of the pallet and the arming mechanism.

Further objects and advantages of the present invention will become apparent as the following description proceeds and the features of novelty characterizing the invention will be pointed out with particularity in the claims annexed to and forming a part of this specification.

BRIEF DESCRIPTION OF THE DRAWING

For a better understanding of the present invention reference may be had to the accompanying drawing wherein.

DESCRIPTION OF THE PREFERRED EMBODIMENT

Figure 1:
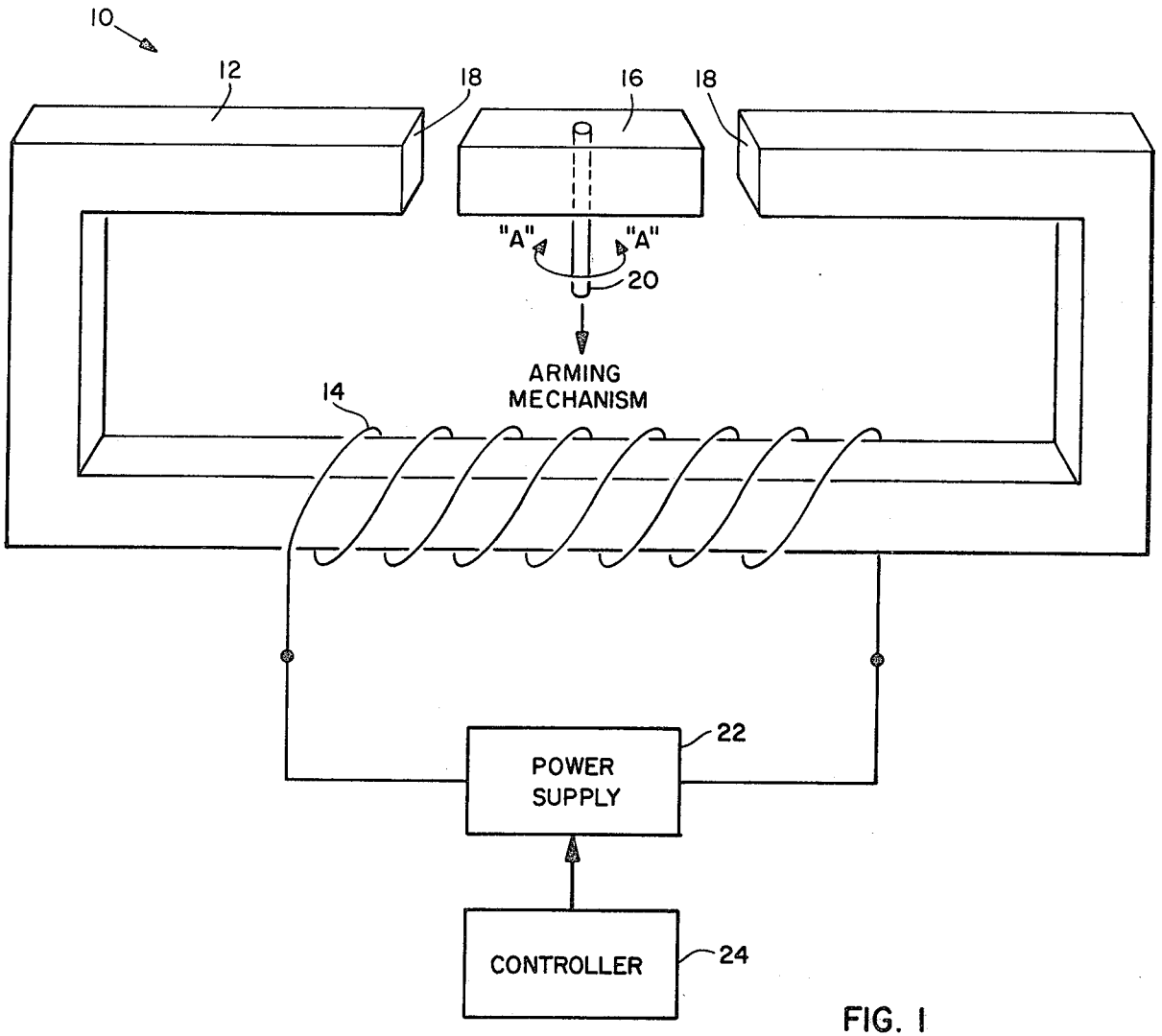
FIG. 1 shows an embodiment of the device of the present invention.

Referring now to the drawing wherein the same reference numerals have been applied to like parts, FIG. 1 shows a device for adjusting the arming time of a projectile having an arming mechanism for arming the projectile at a predetermined rate, generally designated 10, and having a core 12 magnetically excitable by a current flowing through a coil 14 wound upon core 12, and a pallet 16 rotatably movable within an air gap 18 of core 12.

The current through coil 14 generates a magnetic field across air gap 18 and within pallet 16. Magnetic losses, specifically, hysteresis losses and eddy current losses, are induced within pallet 16. The interaction between the magnetic field and pallet 16 causes a retarding effect on pallet 16 to slow down the motion of pallet 16 within the magnetic field. Pallet 16 is connected to the arming mechanism (not shown) and any retarding effect on pallet 16 will reduce the arming rate of the arming mechanism.

Pallet 16 is made of a magnetically susceptable material, the type of material chosen being dependent upon design factors. For a pallet made of a magnetic material, e.g., soft iron or steel, the induced magnetic losses can be either hysteresis or eddy current or both simultaneously. For a pallet 16 made of a non-magnetic material which is magnetically susceptable, e.g., aluminum or brass, the induced magnetic loss will be eddy currents.

Depending upon design considerations, the magnetic field induced in air gap 18 and through pallet 16 can be a steady state magnetic field induced by a direct current through coil 14 or can be an alternating field generated by an alternating current of a chosen frequencies passing through coil 14. For a steady state constant magnetic field, the primary losses induced within pallet 16 made of magnetic material will be hysteresis losses induced within pallet 16 as pallet 16 rotates within air gap 18. For an alternating magnetic field with pallet 16 made of magnetic material, the magnetically induced losses within pallet 16 will be both hysteresis and eddy current losses with the amount of loss being higher as the frequency of the alternating current and the correspondingly generated alternating field is increased. For an alternating magnetic field with pallet 16 made of a non-magnetic magnetically susceptable material the induced magnetic losses will be eddy currents with increased losses at higher frequencies.

It is within the contemplation of the present invention that core 12 can be comprised of a permanent magnet and coil 14 can be wound upon core 12 or about the pallet 16 for adjustably effecting the magnetic field across the air gap 18 and within pallet 16.

More particularly, core 12 is made of a magnetic material such as steel or iron of approximately ¼" (0.635 cm) to ½" (1.27 cm) thick bar bent around forming air gap 18. Coil 14 comprises approximately 300 to 400 turns of wire of appropriate gauge and insulation for carrying approximately 100 to 500 milliamps of AC or DC current. Pallet 16 is a bar of magnetically susceptable material as disclosed hereinabove and in the present embodiment is approximately 1" long and ¼" thick. Pallet 16 is rotatably supported at the axial and longitudinal center thereof within air gap 18 by a shaft 20 which is connected to the arming mechanism (not shown) through a gear train (not shown). Depending upon the coupling from the arming mechanism, pallet 16 can rotate in an oscillatory reciprocal manner as shown by the arrows A—A, or pallet 16 can rotate continuously. It is desirable that the portion of the air gap 18 between pallet 16 and core 12 be as small as practicable to increase coupling of the magnetic field to pallet 16. In the exemplary embodiment, the air gap between core 12 and pallet 16 on each end thereof is typically less than 0.1 inches (0.254 cm) on each longitudinal side of pallet 16 when pallet 16 is aligned with core 12.

The current through coil 14 is provided by power supply 22 which is controlled by a controller 24. For a direct current applied to coil 14, power supply 22 will accordingly be a DC voltage source, typically a battery. The strength of the steady state magnetic field generated by direct current flowing through coil 14 is dependent upon the amount of current through coil 14. Accordingly, magnetically induced losses within pallet 16 are in turn dependent upon the strength of the magnetic field generated in core 12 crossing air gap 18. Thus, the strength of the generated magnetic field, whether steady state or alternating, is dependent upon the strength of the corresponding current through coil 14 and the quantity of the generated magnetic losses within pallet 16 is dependent upon the strength of the magnetic field within core 12 crossing air gap 18. Thus, the losses within pallet 16 can be adjustably controlled by control of the current through coil 14. From a DC supply 22, the quantity of current through coil 14 is adjustably controlled by a controller 24 which can be an adjustable electronic circuit such as an electronically adjustable voltage power supply, or adjustable resistor connected in series with power supply 22. The controller 24 can be in series or parallel with power supply 22 and is shown in FIG. 1 as external to the current flow for illustration block diagram functional purposes only. Thus, for a steady state magnetic field the quantity of direct current from power supply 22 through coil 14 is adjustably controlled and, correspondingly, magnetically induced losses within pallet 16 are thereby adjustably controlled.

For an alternating magnetic field, the magnetically generated losses within pallet 16 can be adjustably controlled by adjustment of either or both the intensity of current through coil 14 or the frequency of the alternating current through coil 14, since hysteresis and eddy current losses increase with increased magnetic field and also with increased frequency. In such a case, the power supply can comprise an oscillator capable of providing the required current to coil 14 with the oscillator frequency being adjustable and the current from the oscillator of power supply 22 being adjustable by adjusting the output voltage of the oscillator in a manner described above for a direct current supply. In such a case, the oscillator can be any oscillator having a frequency range and output voltage and current capable of providing coil 14 with the required current, and the controller 24 and the electronic circuitry thereof or series current resistor can provide an adjustable voltage for adjusting the current through coil 14. In the exemplary embodiment the oscillator is adjustable in frequency between 30 Hz to approximately 2 KHz. It should be noted that due to the inductance of coil 14, generation of a sufficiently high frequency current can result in a reduction of the generated magnetic losses because the impedance of coil 14 increases with frequency thereby causing a decrease of coil current.

Thus there is presented a device for adjusting the arming time of a projectile having an arming mechanism for arming the projectile at a predetermined rate. A pallet made of magnetically susceptable material and supported for repetitive movement is disposed within a generated magnetic field and is driven by the arming mechanism while arming. The pallet is connected to the arming mechanism for corresponding movement therewith. The magnetic field induces magnetic losses within the pallet which retards the movement of the arming mechanism and correspondingly retards the arming rate of the projectile below the predetermined rate.

While there has been illustrated and described what is at present considered to be a preferred embodiment of the present invention, it will be appreciated that numerous changes and modifications are likely to occur to those skilled in the art and it is intended in the appended claims to cover all those changes and modifications which fall within the true spirit and scope of the present invention.

What is claimed as new and desired to be secured by Letters Patent is:

1. A device for adjusting the arming time of a projectile having an arming mechanism for arming the projectile at a predetermined rate comprising:

a pallet made of magnetically susceptable material and supported for repetitive movement, the pallet being connected to the arming mechanism for corresponding movement therewith and driven for movement by the arming mechanism while arming;

electromagnetic means for generating a magnetic field; and means for adjustably inducing the magnetic field within the pallet for retarding movement of the pallet thereby changing the rate of arming to a rate slower than the predetermined rate.

2. The device of claim 1 wherein the electromagnetic means comprises a coil means and the means for adjustably inducing comprises magnetic field strength determining means for adjustably controlling current through the coil means, the strength of the magnetic field being dependent upon the quantity of current, the means for retarding having a strength dependent upon the strength of the magnetic field.

3. The device of claim 1 wherein the electromagnetic means comprises a coil means and the means for adjustably inducing comprises means for adjustably controlling the frequency of current through the coil means, the magnetic field having an alternating field of the frequency of the current, the means for retarding having strength dependent upon the frequency of the alternating magnetic field.

4. The device of claim 1 wherein the movement of the pallet is a reciprocating motion between a first and second position.

5. The device of either claims 1 or 4 wherein the movement of the pallet is rotational movement about an axis of rotation.

6. The device of claim 1 wherein the coil means comprises a plurality of turns of wire wound upon a core.

7. The device of claim 6 wherein the core comprises a magnetic circuit having an air gap and the pallet is disposed within the air gap.

8. The device of claim 2 wherein the field strength determining means comprises electronic circuitry means.

9. The device of claim 1 wherein the pallet is made of a magnetic material susceptable to hysteresis losses and eddy currents.

10. The device of claim 9 wherein the pallet is made of iron.

11. The device of claim 1 wherein the pallet is made of a non-magnetic magnetically susceptable material for generating eddy currents.

12. The device of claim 2 wherein the current through the coil means is a direct current and the magnetic field is a constant field.

13. The device of claim 2 wherein the current through the coil means is an alternating current and the magnetic field is an alternating field.

14. A device for adjustably changing the arming time of a projectile having an arming mechanism for arming the projectile at a predetermined rate comprising:

a pallet made of magnetically susceptable material and supported for repetitive movement, the pallet being connected to the arming mechanism for corresponding movement therewith and driven for movement by the arming mechanism while arming;

electromagnetic means having a coil means for generating a magnetic field, the coil means comprising a plurality of turns of wire wound upon a core, the turns of wire being connectable to an external power supply for deriving current therefrom for generating the magnetic field, the strength of the magnetic field being dependent upon the quantity of current in the coil means, the frequency of the magnetic field being dependent upon the frequency of the current in the coil means, the core comprising a magnetic circuit having an air gap, the pallet being disposed within the air gap;

means for adjustably controlling one of the quantity and frequency of current provided to the coil from the power supply; and means for the magnetic field adjustably inducing within the pallet means for retarding movement of the pallet thereby changing the rate of arming to a rate slower than the predetermined rate, the means for retarding having a strength dependent upon one of the strength and frequency of the magnetic field.

* * * * *